US009632439B2

(12) United States Patent
Ishii

(10) Patent No.: US 9,632,439 B2
(45) Date of Patent: Apr. 25, 2017

(54) ELECTROPHOTOGRAPHIC PHOTORECEPTOR HAVING A TEMPERATURE ADJUSTING MEMBER INSERTED THEREIN, AND IMAGE FORMING APPARATUS INCLUDING THE SAME

(71) Applicant: KYOCERA CORPORATION, Kyoto (JP)

(72) Inventor: Yoshinobu Ishii, Kyoto (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/068,444

(22) Filed: Mar. 11, 2016

(65) Prior Publication Data

US 2016/0195824 A1 Jul. 7, 2016

Related U.S. Application Data

(63) Continuation of application No. PCT/JP2014/075449, filed on Sep. 25, 2014.

(30) Foreign Application Priority Data

Sep. 25, 2013 (JP) ..... 2013-198615

(51) Int. Cl.
*G03G 15/00* (2006.01)
*G03G 5/10* (2006.01)
*G03G 5/043* (2006.01)

(52) U.S. Cl.
CPC ..... *G03G 5/10* (2013.01); *G03G 5/043* (2013.01); *G03G 15/751* (2013.01)

(58) Field of Classification Search
CPC ..... G03G 15/751
USPC ..... 399/96, 159
See application file for complete search history.

(56) References Cited

U.S. PATENT DOCUMENTS

| | | | | |
|---|---|---|---|---|
| 5,768,943 | A | 6/1998 | Kawata et al. | |
| 5,890,395 | A | 4/1999 | Kawata et al. | |
| 7,941,070 | B2 * | 5/2011 | Nakano | G03G 15/751 399/96 |

(Continued)

FOREIGN PATENT DOCUMENTS

| | | |
|---|---|---|
| JP | 61-130964 | 6/1986 |
| JP | 07-072641 | 3/1995 |
| JP | 08-328280 | 12/1996 |

(Continued)

*Primary Examiner* — William J Royer
(74) *Attorney, Agent, or Firm* — Duane Morris LLP

(57) ABSTRACT

There is provided an electrophotographic photoreceptor in which a temperature adjusting member can be installed and rotation axes of a base and a shaft or a bearing of a flange can be adjusted with high accuracy. An electrophotographic photoreceptor according to an embodiment of the invention includes a cylindrical base; a joint portion located at an end portion of the cylindrical base, including a shaft; and a photosensitive layer located on an outer circumferential surface of the cylindrical base, wherein the joint portion includes a penetration hole penetrating along an axial direction of the cylindrical base, the penetration hole configured to allow insertion and extraction of a temperature adjusting member located along an inner circumferential surface of the cylindrical base.

5 Claims, 5 Drawing Sheets

(56) References Cited

U.S. PATENT DOCUMENTS 9,002,232 B2 * 4/2015 Tsukahara et al. .. G03G 15/751
399/96

FOREIGN PATENT DOCUMENTS

| | | |
|---|---|---|
| JP | 2007-171805 | 7/2007 |
| JP | 2010-145817 | 7/2010 |

* cited by examiner

ELECTROPHOTOGRAPHIC PHOTORECEPTOR HAVING A TEMPERATURE ADJUSTING MEMBER INSERTED THEREIN, AND IMAGE FORMING APPARATUS INCLUDING THE SAME

CROSS-REFERENCE TO RELATED APPLICATIONS

The present application is a continuation of International Application No. PCT/JP2014/075449, filed on Sep. 25, 2014, which claims the benefit of Japanese Patent Application No. 2013-198615, filed on Sep. 25, 2013. The contents of these applications are incorporated herein by reference in their entirety.

TECHNICAL FIELD

The present invention relates to an electrophotographic photoreceptor and an image forming apparatus including the same.

BACKGROUND ART

In the related art, as an electrophotographic photoreceptor of an image forming apparatus such as an electrophotographic copier, a laser beam printer, a facsimile, and a printer, an electrophotographic photoreceptor in which a photosensitive layer is formed on a surface of a cylindrical base and a heating member is installed in the base, as disclosed in Patent Literature 1, is adopted, for example. In the electrophotographic photoreceptor in which the heating member is installed in the base as described above, it is possible to suppress occurrence of so-called image deletion.

Meanwhile, an external rotation driving power rotating in a circumferential direction of the electrophotographic photoreceptor is applied to the electrophotographic photoreceptor, and the electrophotographic photoreceptor forms an image on a recording medium while being rotated. Accordingly, in order to obtain excellent images or characters, highly accurate rotation without causing blurring is required using a cylindrical shaft of the electrophotographic photoreceptor as a rotation axis, and therefore, an electrophotographic photoreceptor in which a base and a flange are integrally formed is employed, for example, as disclosed in Patent Literature 2. In addition, in a case of attaching the flange to an end portion of the base, an electrophotographic photoreceptor in which a flange is attached to a base and rotation axes of the base and a shaft or a bearing of the flange are adjusted with high accuracy, is used.

However, in such an electrophotographic photoreceptor, there are such problems that it is impossible to locate the heating member in the base; even if the heating member is located in the base, it is impossible to extract the heating member from the inside of the base, in a case where maintenance is necessary due to disconnection of the heating member; and even when the flange is extracted from the inside of the base, it is necessary to locate the heating member in the base again after maintenance or replacement and rotation axes of the base and a shaft or a bearing of the flange are adjusted with high accuracy.

CITATION LIST

Patent Literature

Patent Literature 1: Japanese Unexamined Patent Publication JP-A 2007-171805

Patent Literature 2: Japanese Unexamined Patent Publication JP-A 7-72641 (1995)

SUMMARY OF INVENTION

Technical Problem

Therefore, an electrophotographic photoreceptor in which a temperature adjusting member can be installed and rotation axes of a base and a shaft or a bearing of a flange can be adjusted with high accuracy, has been required.

Solution to Problem

According to one embodiment of the invention an electrophotographic photoreceptor includes: a cylindrical base; a joint portion located at an end portion of the cylindrical base, including a shaft or a bearing; and a photosensitive layer located on an outer circumferential surface of the cylindrical base, wherein the joint portion includes a penetration hole penetrating along an axial direction of the cylindrical base, the penetration hole configured to allow insertion and extraction of a temperature adjusting member located along an inner circumferential surface of the cylindrical base.

According to another embodiment of the invention an image forming apparatus includes: the electrophotographic photoreceptor mentioned above; and the temperature adjusting member inserted into the electrophotographic photoreceptor.

Advantageous Effects of Invention

According to one embodiment of the invention, the electrophotographic photoreceptor includes: a cylindrical base; a joint portion located at an end portion of the cylindrical base, including a shaft or a bearing; and a photosensitive layer located on an outer circumferential surface of the cylindrical base, wherein the joint portion includes a penetration hole penetrating along an axial direction of the cylindrical base, the penetration hole configured to allow insertion and extraction of a temperature adjusting member located along an inner circumferential surface of the cylindrical base. According to this, the temperature adjusting member may be installed in the electrophotographic photoreceptor and it is possible to realize an electrophotographic photoreceptor which can adjust rotation axes of the base and the shaft or the bearing of the joint portion with high accuracy.

DESCRIPTION OF EMBODIMENTS

Hereinafter, examples of embodiments of an electrophotographic photoreceptor and an image forming apparatus including the same of the invention will be described with reference to the drawings. The following examples are merely examples of the embodiments of the invention, and the invention is not limited to the examples of the embodiments.

First Embodiment of Electrophotographic Photoreceptor

Figure 1:
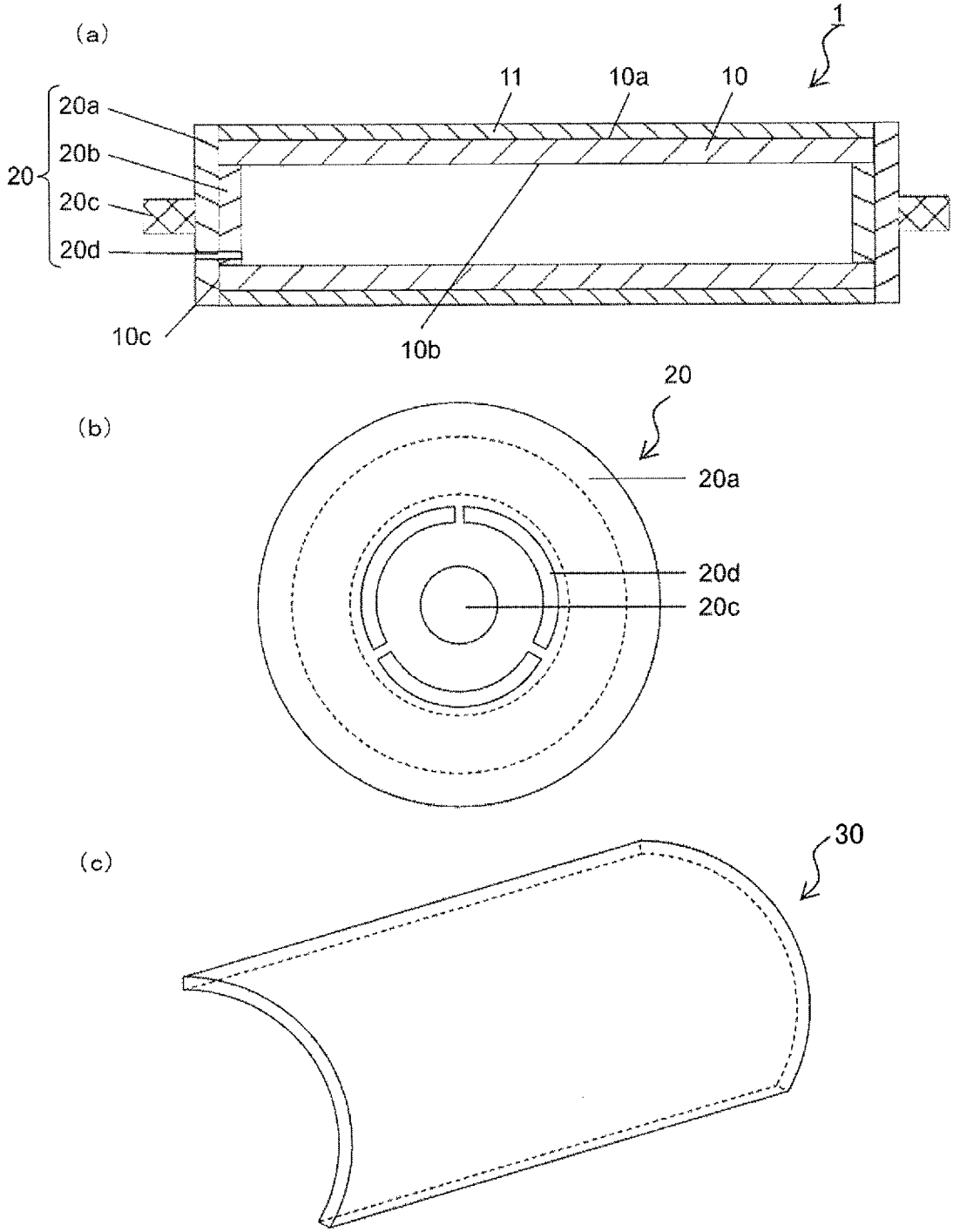
FIG. 1(*a*) is a sectional view showing an example of a first embodiment of an electrophotographic photoreceptor of the invention, FIG. 1(*b*) is an enlarged side view of the electrophotographic photoreceptor shown in FIG. 1(*a*), and FIG. 1(*c*) is a view illustrating a temperature adjusting member used on an inner side of the electrophotographic photoreceptor shown in FIG. 1(*a*)

An electrophotographic photoreceptor 1 shown in FIG. 1 includes a cylindrical base 10, a flange (joint portion) 20 located at an end portion of the cylindrical base 10, including a shaft 20*c*, and a photosensitive layer 11 located on an outer circumferential surface 10*a* of the cylindrical base 10. The electrophotographic photoreceptor 1 of this example is used in an image forming apparatus and plays a role of converting light information into an image on a paper sheet. In this example, the flange 20 includes the shaft 20*c*, but the flange 20 may include a bearing 20*c* for inserting an external shaft having a driving mechanism, instead of the shaft 20*c*.

The photosensitive layer 11 includes an inorganic photosensitive layer formed of an amorphous silicon (a-Si) material and an amorphous selenium (a-Se) material such as Se—Te or As2Se3, and an organic photosensitive layer, and in this example, an inorganic photosensitive layer formed of an amorphous silicon (a-Si) material is adopted.

The cylindrical base 10 serves as a support of the photosensitive layer 11 and is formed as a base having conductivity at least in a surface thereof. This cylindrical base 10 is formed as a base having conductivity in the entire body, by a metal material such as aluminum (Al), zinc (Zn), copper (Cu), iron (Fe), titanium (Ti), nickel (Ni), chromium (Cr), tantalum (Ta), tin (Sn), gold (Au), and silver (Ag) or an alloy material containing the exemplified metal materials, for example, stainless (SUS) steel. In the cylindrical base 10, a conductive film formed of the exemplified metal materials and a transparent conductive material such as indium tin oxide (ITO) or $SnO_2$ may be coated on a surface of an insulator such as a resin, glass, or a ceramic. Among the exemplified materials, it is most preferable to use aluminum (Al) and an alloy material containing this as a material for forming the cylindrical base 10, and it is preferable that the entire cylindrical base 10 is formed of an aluminum (Al) material. By doing so, it is possible to manufacture the light electrophotographic photoreceptor 1 at a low cost, and it is possible to improve reliability by increasing adhesiveness between the photosensitive layer 11 and the cylindrical base 10, in a case of forming the photosensitive layer 11 of an amorphous silicon (a-Si) material. The cylindrical base 10 of this example is formed of aluminum (Al).

The flange 20 includes a flange portion 20*a* which comes into contact with an end surface 10*c* of the cylindrical base 10, a fitting portion 20*b* which comes into contact with an inner circumferential surface 10*b*, the shaft 20*c* which is located on a rotation axis of the cylindrical base 10, that is, the electrophotographic photoreceptor 1, and a penetration hole 20*d* penetrating along an axial direction of the cylindrical base 10. The flange portion 20*a* and the fitting portion 20*b* have a disc shape. A material of the flange 20 is not particularly limited, and the flange 20 is formed of a metal material such as aluminum (Al), zinc (Zn), copper (Cu), iron (Fe), titanium (Ti), nickel (Ni), and chromium (Cr), an alloy material containing the exemplified metal materials, for example, stainless (SUS) steel, a resin material made of a mixture of a carbon fiber with polycarbonate resin or polyamide resin, or a resin material made of a blend of carbon black with polyphenylene sulfide or polyphthalamide. The resin such as polycarbonate is preferable because the flange 20 can be manufactured with low cost and the weight thereof is decreased. The material of the flange 20 of this example is polycarbonate. The flanges 20 are located on the end portions of the cylindrical base 10 by pressing the fitting portions 20*b* to openings of both ends of the cylindrical base 10. That is, the flanges 20 of this example can be detachable from the cylindrical base 10.

The penetration hole 20*d* provided in the flange 20 continuously penetrates through the flange portion 20*a* and the fitting portion 20*b* and functions as an inlet and an outlet for inserting and extracting a planar temperature adjusting member 30 located along the inner circumferential surface 10*b* of the cylindrical base 10. A size and shape of the penetration hole 20*d* are not particularly limited and may have such a size and shape that the planar temperature adjusting member 30 can be inserted and extracted. As shown in FIG. 1(*b*), a sectional shape of the penetration hole 20*d* of this example which is orthogonal to the axial direction of the cylindrical base 10 has an arch shape, and in a plan view of the flange 20 towards the axial direction of the cylindrical base 10, three penetration holes 20*d* having the same circular shape are arranged and located along the outer periphery of the flange 20 (outer periphery of the flange portion 20*a*, outer periphery of the fitting portion 20*b*, and outer periphery and inner periphery of the cylindrical base 10). A lid body for covering the penetration holes 20*d* may be separately provided. By doing so, it is possible to suppress heat transmission through the penetration holes 20*d*, and it is possible to perform temperature adjustment by the planar temperature adjusting member 30 with excellent accuracy. In addition, since it is possible to suppress heat transmission through the penetration holes 20*d* by using a lid body, it is possible to set the penetration holes 20*d* to be larger while ensuring the accuracy of the temperature adjustment. As a result, it is possible to more easily insert and extract the planar temperature adjusting member 30. The lid body may be located in such a position that the opening and closing or attachment/extraction thereof does not affect the precision of the axis. In addition, the lid body may have such a configuration as to be opened and closed or attached/extracted by a bolt or the like. Further, the lid body and the planar temperature adjusting member 30 may be bonded to each other or integrally formed, and according to this, it is possible to perform insertion and extraction, attachment/extraction, and positioning of the planar temperature adjusting member 30 easily or with excellent accuracy. The planar temperature adjusting member 30 of this example can heat the photosensitive layer 11 formed on the outer circumferential surface 10*a* of the cylindrical base 10 and, if necessary, can cool the photosensitive layer 11. A heater is used as an example of the planar temperature adjusting member 30 and a Peltier element can be used. In the electrophotographic photoreceptor 1 of this example, the planar temperature adjusting member 30, as shown in FIG. 1(*c*), for example, is located along the inner circumferential surface 10*b* of the cylindrical base 10. Here, the planar temperature adjusting member 30 may be installed in a position separated from the center axis of the cylindrical base 10 and close to the inner circumferential surface 10*b*, and may or may not come into contact with the inner circumferential surface 10*b*. In addition, a distance between the planar temperature adjusting member 30 and the inner circumferential surface 10*b* of the cylindrical base 10 may be constant. That is, in a case of one planar temperature adjusting member 30, the distance may be constant regardless of areas thereof, and in a case of a plurality of planar temperature adjusting members 30, the distances may be constant to each other. According to this, it is possible to effectively and uniformly transmit heat to the photosensitive layer 11 which is formed on the outer circumferential surface 10*a* of the cylindrical base 10. A sectional shape of the planar temperature adjusting member 30 shown in FIG. 1(*c*) which is orthogonal to a longitudinal direction has an arch shape similar to the shape of the penetration hole 20*d*, and the sectional shape thereof has such a contracted shape that the planar temperature adjusting member 30 can be inserted into and extracted from the inside of the electrophotographic photoreceptor 1 (space surrounded by the inner circumferential surface 10*b* of the cylindrical base 10) through the penetration holes 20*d*. Herein, in the planar temperature adjusting member 30, predetermined elasticity is provided and a radius of curvature of a curved surface can be set to be greater than a radius of curvature of the cylindrical base 10. According to this, it is possible to bring the inner circumferential surface 10*b* of the cylindrical base. 10 and the outer circumferential surface of the planar temperature adjusting member 30 into contact with each other so that the outer circumferential surface bounces with respect to the inner circumferential surface 10*b*, and as a result, it is possible to fix both elements.

Figure 2:
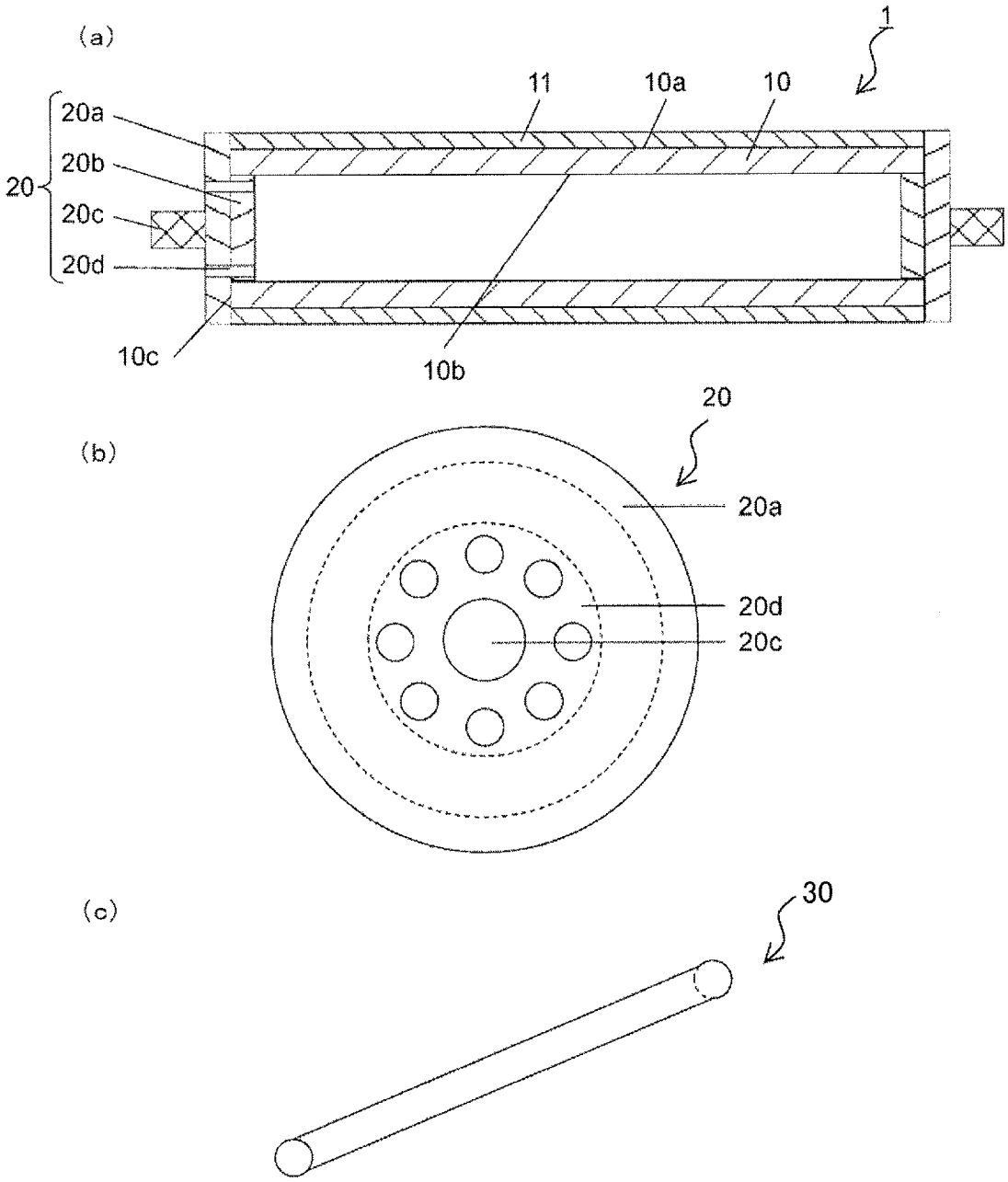
FIG. 2(*a*) is a sectional view showing another example of the first embodiment of the electrophotographic photoreceptor of the invention, FIG. 2(*b*) is an enlarged side view of FIG. 2(*a*), and FIG. 2(*c*) is a view illustrating a temperature adjusting member located on an inner side of the electrophotographic photoreceptor shown in FIG. 2(*a*)

In addition, the shape or the number of the penetration hole 20*d* is not limited thereto. For example, as shown in FIGS. 2(*a*) and 2(*b*), a sectional shape thereof which is orthogonal to the axial direction of the cylindrical base 10 has a circular shape, and in a plan view of the flange 20 towards the axial direction of the cylindrical base 10, eight penetration holes 20*d* having the same circular shape may be arranged and located along the outer periphery of the flange 20 (outer periphery of the flange portion 20*a*, outer periphery of the fitting portion 20*b*, and outer periphery and inner periphery of the cylindrical base 10). In the electrophotographic photoreceptor 1 of this example, a rod-shaped temperature adjusting member 30, as shown in FIG. 2(*c*), for example, is located along the inner circumferential surface 10*b* of the cylindrical base 10. A sectional shape of the rod-shaped temperature adjusting member 30 shown in FIG. 2(*c*) which is orthogonal to the longitudinal direction has a circular shape similar to the shape of the penetration hole 20*d*, and the sectional shape thereof has such a contracted shape that the rod-shaped temperature adjusting member 30 can be inserted into and extracted from the inside of the electrophotographic photoreceptor 1 (space surrounded by the inner circumferential surface 10*b* of the cylindrical base 10) through the penetration holes 20*d*.

In the electrophotographic photoreceptor 1 of this example, the rod-shaped temperature adjusting member 30 can be located along the inner circumferential surface 10*b* of the cylindrical base 10, as described above, and it is possible to restrain the surface of the photosensitive layer 11 from being sensitive to humidity to easily adsorb moisture by repeatedly using the electrophotographic photoreceptor 1, by heating the photosensitive layer 11 formed on the outer circumferential surface 10*a* of the cylindrical base 10 in the rod-shaped temperature adjusting member 30. In addition, it is possible to suppress occurrence of image deletion by the surface charge moving in a horizontal direction due to a decrease in surface resistance of the photosensitive layer 11.

Further, in the electrophotographic photoreceptor 1 of this example, it is possible to perform the insertion and extraction of the rod-shaped temperature adjusting member 30 while mounting the flange 20 on the cylindrical base 10. Accordingly, it is possible to locate the rod-shaped temperature adjusting member 30 along the inner circumferential surface 10*b* of the cylindrical base 10 after temporarily adjusting the rotation axes of the cylindrical base 10 and the shaft 20*c* of the flange 20 with high accuracy, and it is also possible to perform the replacement of the rod-shaped temperature adjusting member 30 while mounting the cylindrical base 10 and the flange 20, even in a case where it is necessary to replace the rod-shaped temperature adjusting member 30 due to disconnection or the like of the rod-shaped temperature adjusting member 30. Therefore, it is possible to maintain a state where the rotation axes of the cylindrical base 10 and the shaft 20*c* of the flange 20 is adjusted with high accuracy.

Second Embodiment of Electrophotographic Photoreceptor

Figure 3:
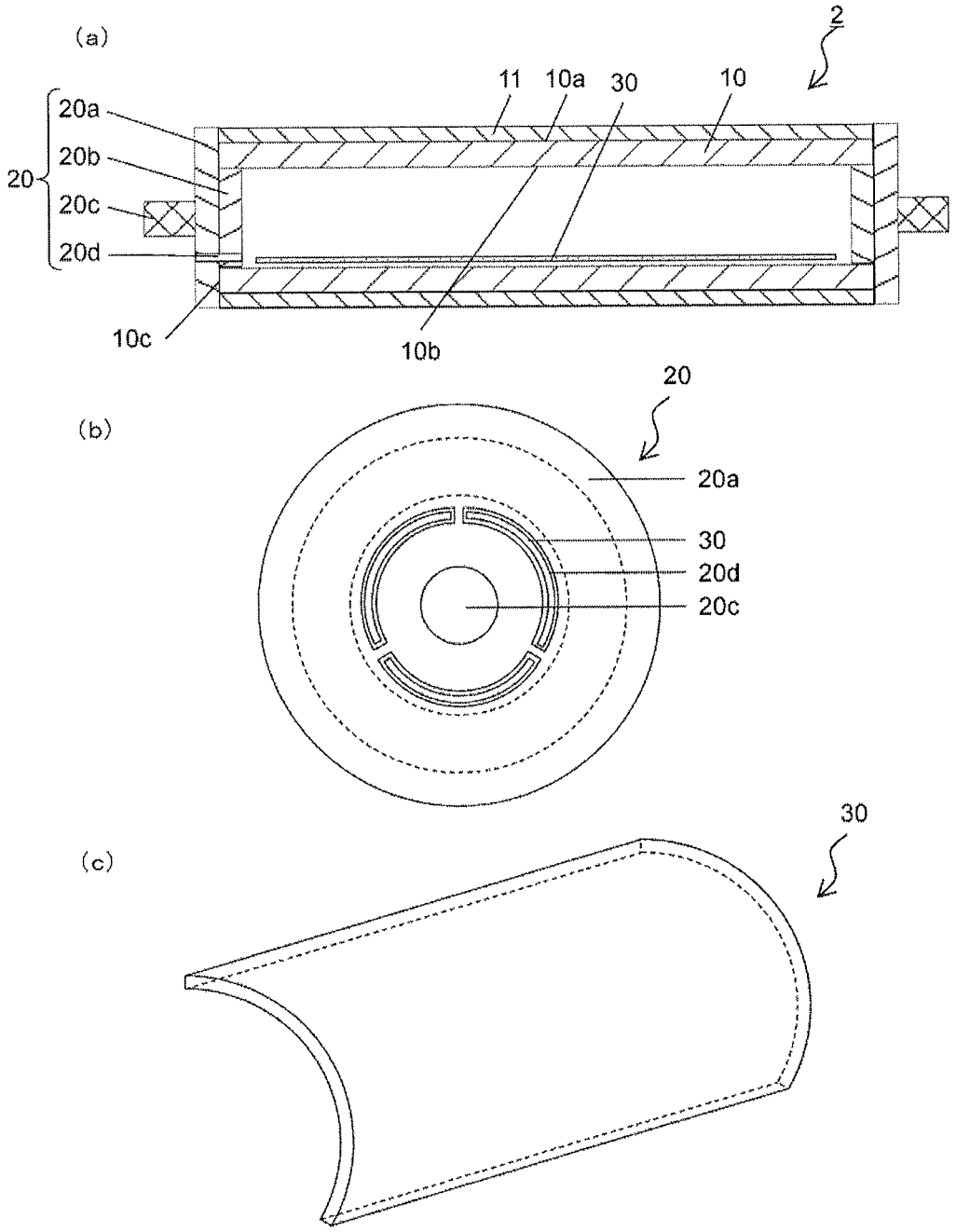
FIG. 3(*a*) is a sectional view showing an example of a second embodiment of the electrophotographic photoreceptor of the invention, FIG. 3(*b*) is an enlarged side view of the electrophotographic photoreceptor shown in FIG. 3(*a*), and FIG. 3(*c*) is a view illustrating a temperature adjusting member located on an inner side of the electrophotographic photoreceptor shown in FIG. 3(*a*)

Next, an example of a second embodiment of the electrophotographic photoreceptor of the invention will be described. FIGS. 3(*a*) to 3(*c*) are views showing an electrophotographic photoreceptor 2 which is an example of the second embodiment of the invention. The configuration of the electrophotographic photoreceptor 2 of this example is the same as that of the electrophotographic photoreceptor 1 which is the example of the first embodiment, except that the temperature adjusting member 30 is located along the inner circumferential surface 10*b* of the cylindrical base 10. Hereinafter, the description of the same configuration as the example of the first embodiment will be omitted by using the same reference numerals.

The temperature adjusting member 30 is not particularly limited, as long as it can perform the temperature adjustment of the electrophotographic photoreceptor 2 (photosensitive layer 11). The temperature adjusting member 30 is heated and cooled to a predetermined temperature by receiving power supplied from an external power through, for example, a slip ring connected to the temperature adjusting member 30. A surface temperature of the electrophotographic photoreceptor 2 may be controlled to be maintained at a predetermined temperature by attaching a sensor for monitoring a surface temperature of the electrophotographic photoreceptor 2 (photosensitive layer 11), if necessary.

The temperature adjusting member 30 is arranged and fixed along the inner circumferential surface 10*b* of the cylindrical base 10. Although any method may be adopted as a fixing method, a method of allowing easy fixation when inserting the temperature adjusting member 30 through the penetration hole 20*d* is preferable. For example, both end surfaces along the longitudinal direction of the temperature adjusting member 30, that is, the axial direction of the cylindrical base 10, and the penetration hole 20*d* may interpose at least one portion of the end surface located on the opposite side by a flat spring to be fixed. Here, the flat spring is inserted through the penetration hole 20*d* and spread in the cylindrical base 10 so as to press both end portions of the temperature adjusting member 30 against the inner circumferential surface 10*b* of the cylindrical base 10. When extracting the temperature adjusting member 30 fixed as described above, a part of the flat spring may be grasped and extracted by a member inserted through the penetration hole 20*d* and the temperature adjusting member 30 may be extracted. In addition, in the electrophotographic photoreceptor 2 of this example, the inner circumferential surface 10*b* of the cylindrical base 10 and the temperature adjusting member 30 are located at a predetermined distance, but may be located to come into contact with each other. Since it is preferable that the photosensitive layer 11 is evenly and effectively heated by the temperature adjusting member 30, it is preferable that the temperature adjusting member 30 is evenly located as close to the inner circumferential surface 10*b* of the cylindrical base 10 as possible.

In the electrophotographic photoreceptor 2 of this example, the temperature adjusting member 30 is located along the inner circumferential surface 10*b* of the cylindrical base 10, as described above, and it is possible to restrain the surface of the photosensitive layer 11 from being sensitive to humidity to easily adsorb moisture by repeatedly using the electrophotographic photoreceptor 2, by heating the photosensitive layer 11 formed on the outer circumferential surface 10*a* of the cylindrical base 10. In addition, it is possible to suppress occurrence of image deletion by the surface charge moving in a horizontal direction due to a decrease in surface resistance of the photosensitive layer 11.

Further, in the electrophotographic photoreceptor 2 of this example, it is possible to perform the insertion and extraction of the temperature adjusting member 30 while mounting the flange 20 on the cylindrical base 10. Accordingly, it is possible to locate the temperature adjusting member 30 along the inner circumferential surface 10*b* of the cylindrical base 10 after temporarily adjusting the rotation axes of the cylindrical base 10 and the shaft 20*c* of the flange 20 with high accuracy, and it is also possible to perform the replacement of the temperature adjusting member 30 while mounting the cylindrical base 10 and the flange 20, even in a case where it is necessary to replace the temperature adjusting member 30 due to disconnection or the like of the temperature adjusting member 30. Therefore, it is possible to maintain a state where the rotation axes of the cylindrical base 10 and the shaft 20*c* of the flange 20 is adjusted with high accuracy.

Image Forming Apparatus

Figure 4:
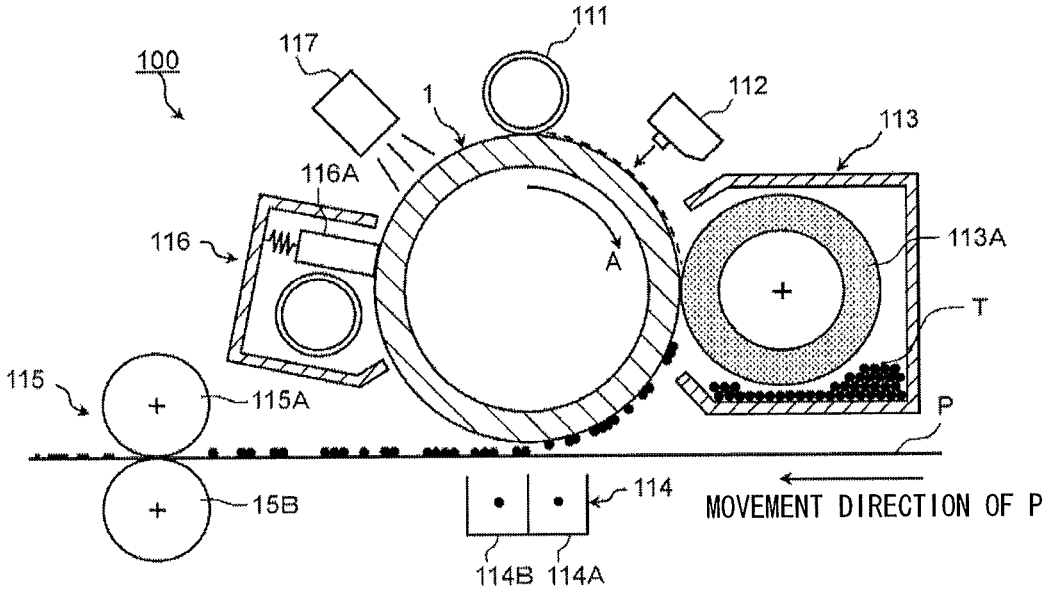
FIG. 4 is a sectional view of an image forming apparatus of the invention.

An image forming apparatus 100 shown in FIG. 4 uses the Carlson method as an image forming method, and includes the electrophotographic photoreceptor 1, a charging device 111, an exposure device 112, a developing device 113, a transfer device 114, a fixing device 115, a cleaning device 116, and a charge removing device 117.

The charging device 111 serves to charge the surface of the electrophotographic photoreceptor 1 in a negative polarity. A charging voltage is set to be from 200 V to 1000 V, for example. In the embodiment, a contact type charging device configured by coating a cored bar with conductive rubber or polyvinylidene fluoride (PVDF), for example, is used as the charging device 111, but instead of this, a non-contact type charging device (for example, corona charger) including a discharged wire may be used.

The exposure device 112 serves to form an electrostatic latent image on the electrophotographic photoreceptor 1. Specifically, the exposure device 112 emits exposure light (for example, a laser light) at a specific wavelength (for example, from 650 nm to 780 nm) to the electrophotographic photoreceptor 1 according to an image signal, to attenuate a potential of an exposure light irradiated portion of the electrophotographic photoreceptor 1 in a charged state and form an electrostatic latent image. An LED head comprising an array of a plurality of LED elements (wavelength: 680 nm) can be used, for example, as the exposure device 112.

An element which can emit laser light can also be used as a light source of the exposure device 112, instead of the LED elements. That is, an optical system containing a polygon mirror may be used instead of the exposure device 112 such as the LED head. Alternatively, an image forming apparatus having a configuration of a copier can be realized by using an optical system including a lens and a mirror causing passage of a reflected light from a document.

The developing device 113 serves to develop the electrostatic latent image of the electrophotographic photoreceptor 1 and forms a toner image. The developing device 113 of this example includes a magnetic roller 113A which magnetically holds a developer (toner) T.

The developer T configures a toner image which is formed on a surface of the electrophotographic photoreceptor 1, and is frictionally charged in the developing device 113. Examples of the developer T include a two-component developer including a magnetic carrier and an insulating toner, and a single-component developer including a magnetic toner.

The magnetic roller 113A transports the developer to a surface (developing area) of the electrophotographic photoreceptor 1. The magnetic roller 113A conveys the developer T which has been frictionally charged in the developing device 113, in a form of a magnetic brush adjusted to a given ear length. The conveyed developer T is attached to the surface of the electrophotographic photoreceptor 1 by electrostatic attraction with the electrostatic latent image in the developing area of the electrophotographic photoreceptor 1 to form a toner image (visualize the electrostatic latent image). A charging polarity of the toner image is set to be a polarity opposite to the charging polarity of the surface of the electrophotographic photoreceptor 1, in a case of performing image formation by charged area development, and the charging polarity thereof is set to be the same polarity as the charging polarity of the surface of the electrophotographic photoreceptor 1, in a case of performing image formation by discharged area development.

In addition, in this example, the developing device 113 uses a dry developing method, but may use a wet developing method using a liquid developer.

The transfer device 114 serves to transfer the toner image on the electrophotographic photoreceptor 1 onto a recording medium P fed to a transfer area between the electrophotographic photoreceptor 1 and the transfer device 114. The transfer device 114 of this example includes a transfer charger 114A and a separating charger 114B. In the transfer device 114, a rear surface (non-recording surface) of the recording medium P is charged in a polarity opposite to that of the toner image in the transfer charger 114A, and the toner image is transferred onto the recording medium P by electrostatic attraction between this electric charge and the toner image. In addition, in the transfer device 114, at the same time as the transfer of the toner image, the rear surface of the recording medium P is AC-charged in the separating charger 114B, and the recording medium P is rapidly separated from the surface of the electrophotographic photoreceptor 1.

As the transfer device 114, a transfer roller which is driven by the rotation of the electrophotographic photoreceptor 1 and located at a minute interval (normally, equal to or smaller than 0.5 mm) from the electrophotographic photoreceptor 1 can also be used. This transfer roller applies a transfer voltage so as to transfer the toner image on the electrophotographic photoreceptor 1 onto the recording medium P by a DC power source, for example. In a case of using the transfer roller, a transfer separating device such as the separating charger 114B can be omitted.

The fixing device 115 serves to fix the toner image transferred to the recording medium P onto the recording medium P and includes a pair of fixing rollers 115A and 115B. The fixing rollers 115A and 115B includes a metal roller and a coating of tetrafluoroethylene or the like on a surface of the metal roller. In the fixing device 115, the toner image can be fixed to the recording medium P by applying heat and pressure to the recording medium P passing between the pair of fixing rollers 115A and 115B.

The cleaning device 116 serves to remove the toner remaining on the surface of the electrophotographic photoreceptor 1 and includes a cleaning blade 116A. The cleaning blade 116A scrapes the remaining toner from the surface of the electrophotographic photoreceptor 1. The cleaning blade 116A is formed of a rubber material containing a polyurethane resin as a main component, for example.

The charge removing device 117 serves to remove a surface charge of the electrophotographic photoreceptor 1 and can emit light at a specific wavelength (for example, equal to or higher than 780 nm). The charge removing device 117 is configured to remove the surface charge (remaining electrostatic latent image) of the electrophotographic photoreceptor 1 by irradiating the entire surface of the electrophotographic photoreceptor 1 in an axial direction thereof with light by a light source such as an LED, for example.

In the image forming apparatus 100 of this example, the above-mentioned effects of the electrophotographic photoreceptor 1 can be exhibited.

In addition, the electrophotographic photoreceptor 2 may be adopted instead of the electrophotographic photoreceptor 1 constituting the image forming apparatus of this example.

Hereinabove, the examples of the specific embodiments of the invention have been described, but the invention is not limited thereto, and various modifications are possible without departing from the scope of the invention.

Figure 5:
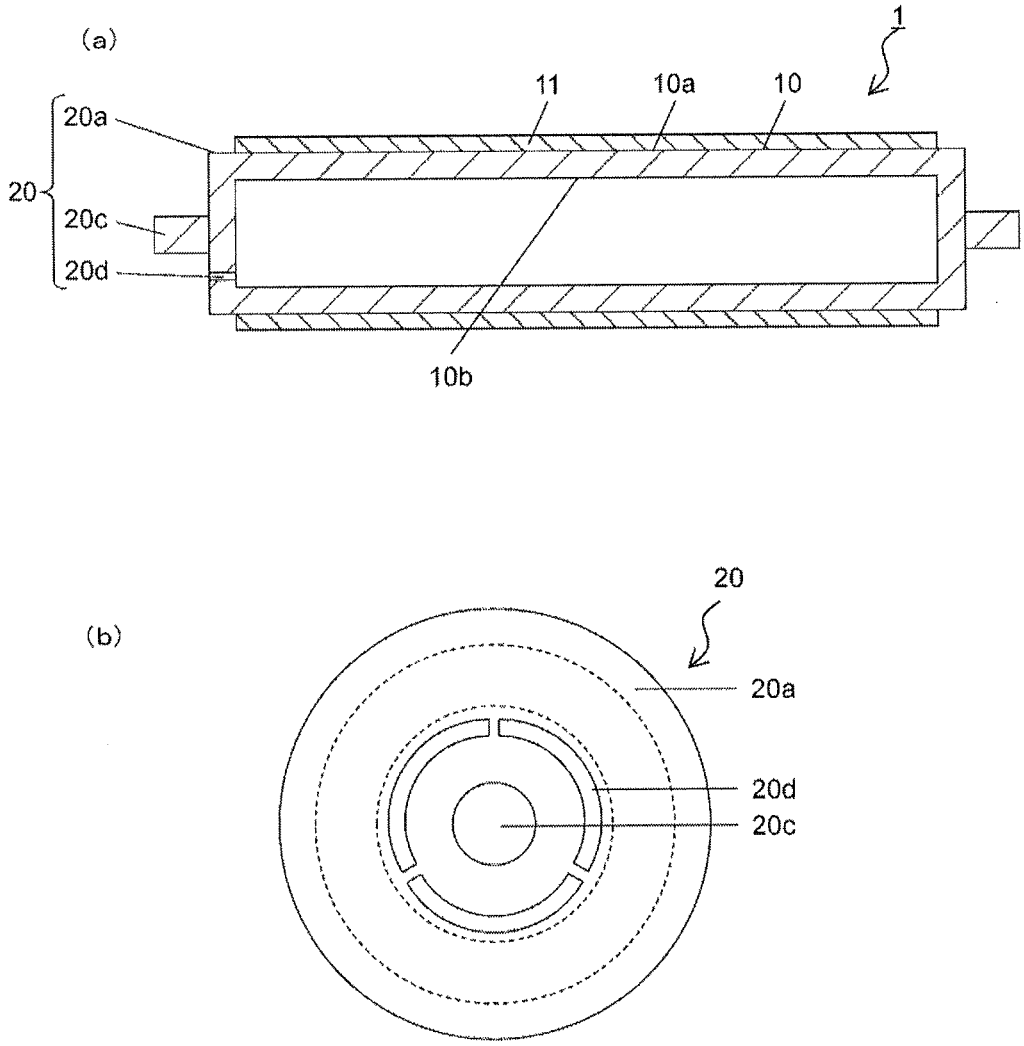
FIG. 5(*a*) is a sectional view showing a modified example of the electrophotographic photoreceptor shown in FIG. 1(*a*), and FIG. 5(*b*) is an enlarged side view of the electrophotographic photoreceptor shown in FIG. 5(*a*).

For example, as a modified example shown in FIG. 5, in a case of the cylindrical base 10 and the flange 20, the flange 20 may be integrally formed with the cylindrical base 10. Herein, an expression "integrally" means that the cylindrical base 10 and the flange 20 are not detachable from each other. In order to integrally form the cylindrical base 10 and the flange 20, the cylindrical base 10 and the flange 20 are manufactured by a metal material such as aluminum (Al), zinc (Zn), copper (Cu), iron (Fe), titanium (Ti), nickel (Ni), chromium (Cr), tantalum (Ta), tin (Sn), gold (Au), and silver (Ag) or an alloy material containing the exemplified metal materials, for example, stainless (SUS) steel, and the cylindrical base 10 and the flange 20 are bonded to each other by welding. In addition, the cylindrical base 10 and the flange 20 may be integrally formed by injection molding using a resin material made of a mixture of a carbon fiber with a polycarbonate resin or a polyamide resin or a resin material made of a blend of carbon black with polyphenylene sulfide or polyphthalamide. With such a configuration, it is possible to adjust the rotation axes of the base 10 and a shaft or a bearing of the flange 20 with higher accuracy.

In addition, the image forming apparatus 100 may include the temperature adjusting member 30 inserted into the electrophotographic photoreceptor 1, in addition to the electrophotographic photoreceptor 1.

REFERENCE SIGNS LIST

1: Electrophotographic photoreceptor
10: Cylindrical base
10*a*: Outer circumferential surface
10*b*: Inner circumferential surface
10*c*: End surface
11: Photosensitive layer
20: Flange (joint portion)
20*a*: Flange portion
20*b*: Fitting portion
20*c*: Shaft
20*d*: Penetration hole
30: Temperature adjusting member
100: Image forming apparatus
111: Charging device
112: Exposure device
113: Developing device
114: Transfer device
115: Fixing device
116: Cleaning device
117: Charge removing device

The invention claimed is:

1. An electrophotographic photoreceptor, comprising:
a cylindrical base;
a joint portion located at an end portion of the cylindrical base, comprising a shaft or a bearing; and
a photosensitive layer located on an outer circumferential surface of the cylindrical base,
wherein the joint portion comprises a penetration hole penetrating along an axial direction of the cylindrical base, the penetration hole configured to allow insertion and extraction of a temperature adjusting member located along an inner circumferential surface of the cylindrical base.

2. The electrophotographic photoreceptor according to claim 1,
wherein the joint portion is integrally formed with the cylindrical base.

3. The electrophotographic photoreceptor according to claim 1, further comprising
the temperature adjusting member located along the inner circumferential surface of the cylindrical base.

4. An image forming apparatus, comprising:
the electrophotographic photoreceptor according to claim 1; and
a charging device configured to charge a surface of the electrophotographic photoreceptor.

5. An image forming apparatus, comprising:
the electrophotographic photoreceptor according to claim 1; and
the temperature adjusting member located along the inner circumferential surface of the electrophotographic photoreceptor.

* * * * *